US011401633B2

(12) United States Patent
You et al.

(10) Patent No.: US 11,401,633 B2
(45) Date of Patent: Aug. 2, 2022

(54) SEAMLESS DOUBLE-WOVEN FABRIC FOR FILLING DOWN

(71) Applicant: ONECHANGMATERIAL CO., LTD., Daegu (KR)

(72) Inventors: Ku Gen You, Daegu (KR); Young Baek Chae, Daegu (KR)

(73) Assignee: ONECHANGMATERIAL CO., LTD., Daegu (KR)

( * ) Notice: Subject to any disclaimer, the term of this patent is extended or adjusted under 35 U.S.C. 154(b) by 205 days.

(21) Appl. No.: 16/756,038

(22) PCT Filed: May 23, 2019

(86) PCT No.: PCT/KR2019/006223

§ 371 (c)(1),
(2) Date: Apr. 14, 2020

(87) PCT Pub. No.: WO2020/235728

PCT Pub. Date: Nov. 26, 2020

(65) Prior Publication Data

US 2021/0404095 A1 Dec. 30, 2021

(51) Int. Cl.
*D03D 11/02* (2006.01)
*D03D 15/283* (2021.01)
(Continued)

(52) U.S. Cl.
CPC ..... *D03D 11/02* (2013.01); *D03D 15/00* (2013.01); *D03D 15/283* (2021.01)

(58) Field of Classification Search
CPC ..... D03D 11/02; D03D 1/00; D03D 11/00; D03D 15/00; D03D 25/005; D03D 13/004;
(Continued)

(56) References Cited

U.S. PATENT DOCUMENTS 10,323,341 B2 * 6/2019 Tone ..... D03D 1/00
10,480,105 B2 * 11/2019 Steel ..... D03D 13/004
(Continued)

FOREIGN PATENT DOCUMENTS

KR 20-0204807 Y1 12/2000
KR 20-0313377 Y1 5/2003
(Continued)

OTHER PUBLICATIONS

Office action dated May 17, 2021 from Korean Patent Office in a counterpart Korean Patent Application No. 10-2020-7005356 (all the cited references are listed in this IDS.) (English translation is also submitted herewith.).

*Primary Examiner* — Robert H Muromoto, Jr.
(74) *Attorney, Agent, or Firm* — Pleechae IP, LLC

(57) ABSTRACT

A seamless double-woven fabric for filling down includes a first fabric layer including first warps and first wefts, a second fabric layer including second warps and second wefts, and a coupling part to partition a down filling part formed between the first and second fabric layers into down filling spaces. The first warp and the second warp are formed so as to be crossed to each other one time or at least two times through a coupling weft. If the number of the coupling wefts is 2n, wherein n is an integer of 1 or more, the first and second fabric layers are arranged to be crossed about the coupling part. If the number of the coupling wefts is 2n+1, wherein n is an integer of 0 or more, the first and second fabric layers are arranged not to be crossed.

7 Claims, 8 Drawing Sheets

(51) Int. Cl.
*D03D 15/00* (2021.01)
*D03D 15/20* (2021.01)

(58) Field of Classification Search
CPC ..... D03D 1/02; D03D 3/02; D03D 1/0043; D03D 1/04; D03D 25/00; D03D 1/0005; D03D 1/0017; D03D 13/00; D03D 1/08; D03D 3/00; D10B 2403/021; D10B 2403/023; D10B 2403/033; D10B 2403/0113; D10B 2403/03; D10B 2403/022; D10B 2403/0333
See application file for complete search history.

(56) References Cited

U.S. PATENT DOCUMENTS

| | | | | |
|---|---|---|---|---|
| 2012/0183754 | A1* | 7/2012 | Kitagawa | D03D 15/00 428/212 |
| 2013/0035014 | A1* | 2/2013 | Tone | D03D 13/008 442/189 |
| 2017/0172240 | A1* | 6/2017 | Massey | A41D 31/04 |
| 2019/0309450 | A1* | 10/2019 | Gretton | A41D 13/0015 |

FOREIGN PATENT DOCUMENTS

| | | | |
|---|---|---|---|
| KR | 10-2004-0040023 | A | 5/2004 |
| KR | 10-1446266 | B1 | 10/2014 |
| KR | 10-1874737 | B1 | 7/2018 |
| KR | 10-1914280 | B1 | 11/2018 |
| KR | 10-1933013 | B1 | 3/2019 |
| KR | 10-2024134 | B1 | 9/2019 |

* cited by examiner

SEAMLESS DOUBLE-WOVEN FABRIC FOR FILLING DOWN

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2019/006223 filed on May 23, 2019, the entire contents of which are incorporated herein by reference.

TECHNICAL FIELD

The present invention relates to a seamless double-woven fabric for filling down.

BACKGROUND ART

Generally, down refers to hair of a goose or duck having excellent thermal insulation properties and lightweight, and is used to manufacture garments or bedclothes. Further, down includes a mixture of feathers and hairs of the neck and breast of a duck or goose. Typically, the hairs and feathers are blended in a predetermined mixing ratio and used.

A down product has a structure including a down filling part filled with down, wherein the down filling part is partitioned to have multiple spaces by sewing between an outer cloth and an inner cloth (lining) of a fabric upon manufacturing. Partitioning the down filling part may prevent the down from concentrating to any one side, and allows the down to be uniformly distributed throughout a product such as garments or bedclothes.

However, there has been constantly indicated a problem that the filled down comes out through seams. Further, with a recent trend of narrowing the down filling part, the number of stitches is increased, hence causing more serious down leakage.

SUMMARY

One object of the present invention is provided a seamless double-woven fabric.

Another object of the present invention is to provide a woven fabric having seamless down filling spaces formed therein.

In addition, another object of the present invention is to a woven fabric with improved air-tightness in a space filled with down.

Further, another object of the present invention is to a woven fabric with improved thermal insulation properties.

Furthermore, another object of the present invention is to a woven fabric able to reduce processing costs and time.

According to one aspect of the present invention, there is provided a seamless double-woven fabric for filling down, including: a first fabric layer including a plurality of first warps and a plurality of first wefts; a second fabric layer including a plurality of second warps and a plurality of second wefts; and a coupling part configured to partition a down filling part formed between the first and second fabric layers into a plurality of down filling spaces, wherein the first warp and the second warp are formed so as to be crossed to each other one time or at least two times through a coupling weft, wherein, if the number of the coupling wefts is 2 n (wherein n is an integer of 1 or more), the first and second fabric layers are arranged to be crossed about the coupling part, and if the number of the coupling wefts is 2 n+1 (wherein n is an integer of 0 or more), the first and second fabric layers are arranged not to be crossed.

The first and second warps, and the first and second wefts respectively may include at least one of: nylon yarn, polyester yarn, polyester mechanical stretch, Spandex yarn, a covering yarn including nylon yarn or polyester yarn, and a composite yarn including nylon yarn or polyester yarn in a core or cis structure.

The first and second wefts and the coupling weft respectively may include: a first yarn; and a second yarn having a larger cross-sectional aspect ratio than that of the first yarn.

At least some wefts of the first and second wefts, which are adjacent to the coupling part, may consist of the second yarns.

The coupling weft may consist of the second yarns.

At least one of the first weft and the second weft may have a fineness of 5 to 70 deniers.

The first warp, the first weft, the second warp and the second weft respectively may have a fineness of 5 to 70 deniers, and the first fabric layer and the second fabric layer have a warp density of 157 to 207 pieces/cm and a weft density of 126 to 142 pieces/cm.

According to another aspect of the present invention, there is provided a seamless double-woven fabric for filling down, including: a first fabric layer including a plurality of first warps and a plurality of first wefts; and a second fabric layer including a plurality of second warps and a plurality of second wefts, wherein the first and second fabric layers include: a coupling part configured to partition a down filling part formed between the first and second fabric layers into a plurality of down filling spaces, wherein the first warp and the second warp are provided so as to be crossed to each other at least one time; and a space forming part to form the plurality of down filling spaces, wherein the first and second wefts include: a first yarn; a second yarn which has a larger cross-sectional aspect ratio than that of the first yarn, and is disposed at a portion adjacent to the coupling part in the space forming part.

The first and second wefts may include: a coupling weft which is located in the coupling part so that the first and second warps are crossed to each other at least two times, and has a larger aspect ratio than that of the first yarn.

In addition, according to another aspect of the present invention, there is provided a seamless double-woven fabric for filling down, including: a first fabric layer including a plurality of first warps and a plurality of first wefts; a second fabric layer including a plurality of second warps and a plurality of second wefts; and a coupling part configured to partition a down filling part formed between the first and second fabric layers into a plurality of down filling spaces, wherein the first warp and the second warp are provided so as to be crossed to each other at least one time, wherein the first and second fabric layers are configured so that a cross-alignment of these layers is changed about the coupling part depending upon the number of crossing the first and second warps at the coupling part.

According to one aspect of the present invention, the woven fabric may have a seamlessly partitioned fabric layer.

According to another aspect of the present invention, the woven fabric may have a variety of patterns by omitting seams.

In addition, according to another aspect of the preset invention, the woven fabric have enhanced thermal insulation properties by omitting seams to improve air tightness of a space filled with down.

Further, according to another aspect of the present invention, a plurality of fabric layers may be simultaneously woven to reduce processing costs and time, as well as pre-treatment and a dyeing process of the fabric layers may be easily implemented.

DETAILED DESCRIPTION

Figure 1:
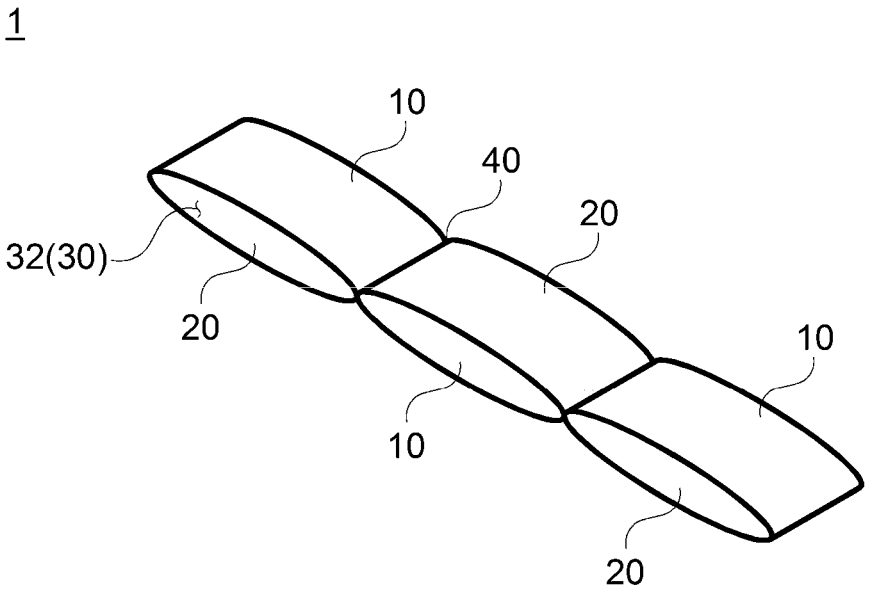
FIGS. 1 and 2 are perspective views illustrating a woven fabric according to one embodiment of the present invention.

Configurations illustrated in the embodiments and drawings of the present disclosure are only preferred examples of the invention, and diverse modifications capable of replacing the embodiments and drawings of the present disclosure may be possible at a time of filing the present application.

Further, the same reference numerals or symbols in the drawings of the present disclosure will represent parts or components having substantially the same functions.

In addition, the terminology used herein is for the purpose of describing particular embodiments only and is not intended to limit the present invention thereto. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Further, the terms including numerals such as "first," "second," etc. in the present disclosure may be used to explain different components, but such components are not limited thereto. These terms are used only to distinguish one component from other components. For example, a first component may also be named a second component without departing from the scope of the present invention. Likewise, the second component may also be named the first component. The term "and/or" may include a combination of a plurality of related items and/or any one among the plurality of related items.

In addition, the terms such as "part," "device," "block," "member," "module," and the like may refer to a unit to execute at least one function or operation. For example, the terms may refer to at least one hardware such as a field-programmable gate array (FPGA) or an application specific integrated circuit (ASIC), at least one operating process performed by at least one software stored in a memory or processor.

Hereinafter, the embodiments of the present invention will be described in detail with respect to the drawings.

Figure 2:
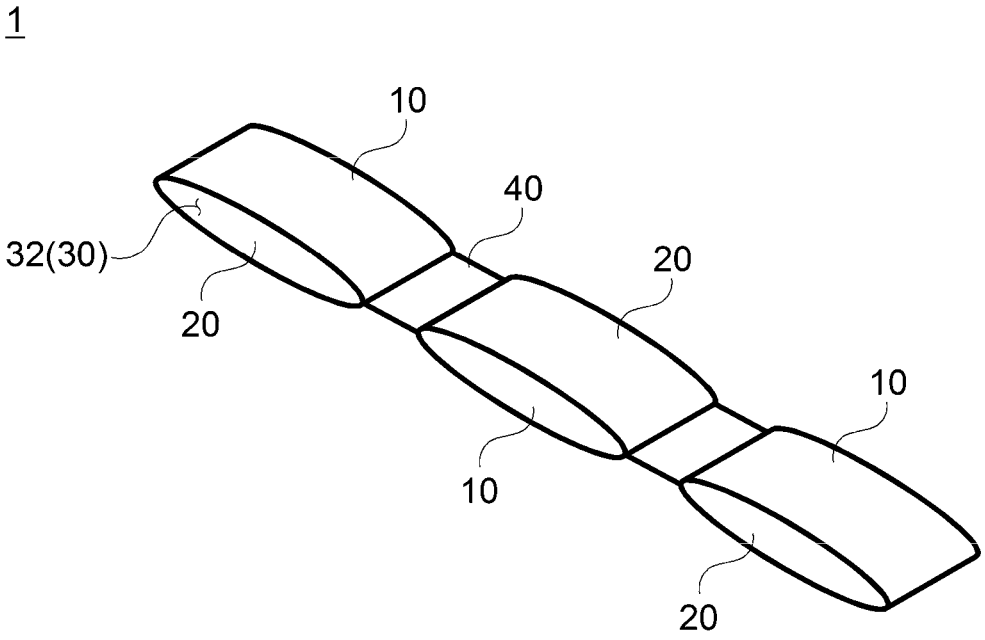
Figure 3:
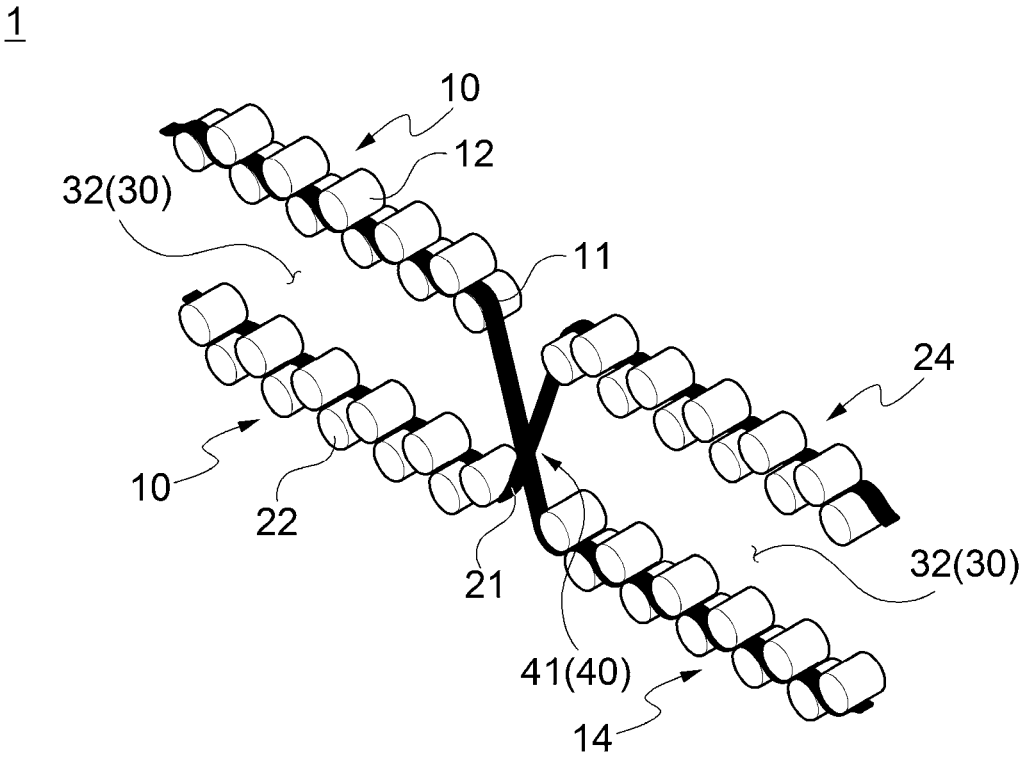
FIG. 3 is an enlarged perspective view illustrating a portion of the woven fabric according to one embodiment of the present invention.

FIGS. 1 and 2 are perspective views illustrating a woven fabric according to one embodiment of the present invention, and FIG. 3 is an enlarged perspective view illustrating a portion of the woven fabric according to one embodiment of the present invention. FIG. 3 is a view illustrating warps and wefts of a woven fabric 1 in an enlarged manner.

The woven fabric 1 may include first and second fabric layers 10 and 20. The fabric layers 10 and 20 may be configured by repeatedly crossing the warps and wefts at right angles.

The first fabric layer 10 may include a plurality of first warps 11 and first wefts 12, while the second fabric layer 20 may include a plurality of second warps 21 and second wefts 22.

The woven fabric 1 may further include a down filling part 30 formed between the first fabric layer 10 and the second fabric layer 20 to be filled with down. The down filling part 30 may be filled with a filler such as duck down, goose down or the like. Further, the down filling part 30 may also be filled with other fillers such as artificial cotton, wool hair, silk, etc. as well as air.

The woven fabric 1 may further include a coupling part 40 configured to partition the down filling part 30 into a plurality of down filling spaces 32. The coupling part 40 may be formed by intercrossing the first fabric layer 10 and the second fabric layer 20. In the coupling part 40, the plurality first and second warps 11 and 12 may be formed so as to be crossed to each other. The coupling part 40 will be further described in detail below.

The woven fabric 1 may include space forming parts 14 and 24. In the first and second fabric layers 10 and 20, the remaining portions except for the coupling part 40 may be defined as the space forming parts 14 and 24. The coupling part 40 and the space forming parts 14 and 24 may be provided as one component of the first and second fabric layers 10 and 20, respectively. The space forming parts 14 and 24 may form the down filling space 32. The coupling part 40 and the space forming parts 14 and 24 may be arranged alternately in the first and second fabric layers 10 and 20. That is, the coupling part 40 and the space forming parts 14 and 24 may be arranged alternately in an X direction in FIGS. 1 and 2.

In the woven fabric 1, the first fabric layer 10 and the second fabric layer 20 may be arranged to be crossed to each other. That is, the first fabric layer 10 and the second fabric layer 20 may be arranged to be positioned alternately inside and outside about the coupling part 40. In other words, the first and second fabric layers 10 and 20 may be arranged so as to be crossed in a Y direction about the coupling part 40. However, it is not limited thereto, and as described below, the first and second fabric layers and 20 may also be arranged so as not to be crossed depending upon types of the coupling part 40. Such a cross-alignment of the first and second fabric layers 10 and 20 will be described in detail below.

The plurality of first and second warps 11 and 21, and the plurality of first and second wefts 12 and 22 in the woven fabric 1 may each independently include at least one selected from the group consisting of nylon yarn, polyester yarn, polyester mechanical stretch, Spandex yarn, a covering yarn including nylon yarn or polyester yarns, and a composite yarn including nylon yarn or polyester yarn in a core or cis structure.

At least one weft of the plurality of first wefts 12 and second wefts 22 may be formed with a fineness of 5 to 70 deniers.

The plurality of first and second warps, and the first and second wefts may be formed with a fineness of 5 to 70 deniers, respectively. Further, the first fabric layer 10 and the second fabric layer 20 may have a warp density of 157 to 207 pieces/cm and a weft density of 126 to 142 pieces/cm, respectively. Within the above fineness and density ranges, a light-weight fabric having excellent intensity may be manufactured. If the fineness is less than 5 deniers, the filler filled in the down filling part 30 may spill out or the filler may be seen through the fabric. Meanwhile, when the fineness exceeds 70 deniers, a problem associated with overweight of the down garment may occur. Further, when the warp density is less than 157 pieces/cm or the weft density is less than 126 pieces/cm, the filler may spill out. Meanwhile, when the warp density exceeds 207 pieces/cm or the weft density exceeds 142 pieces/cm, a problem that a weaving rate is reduced may occur.

Figure 4:
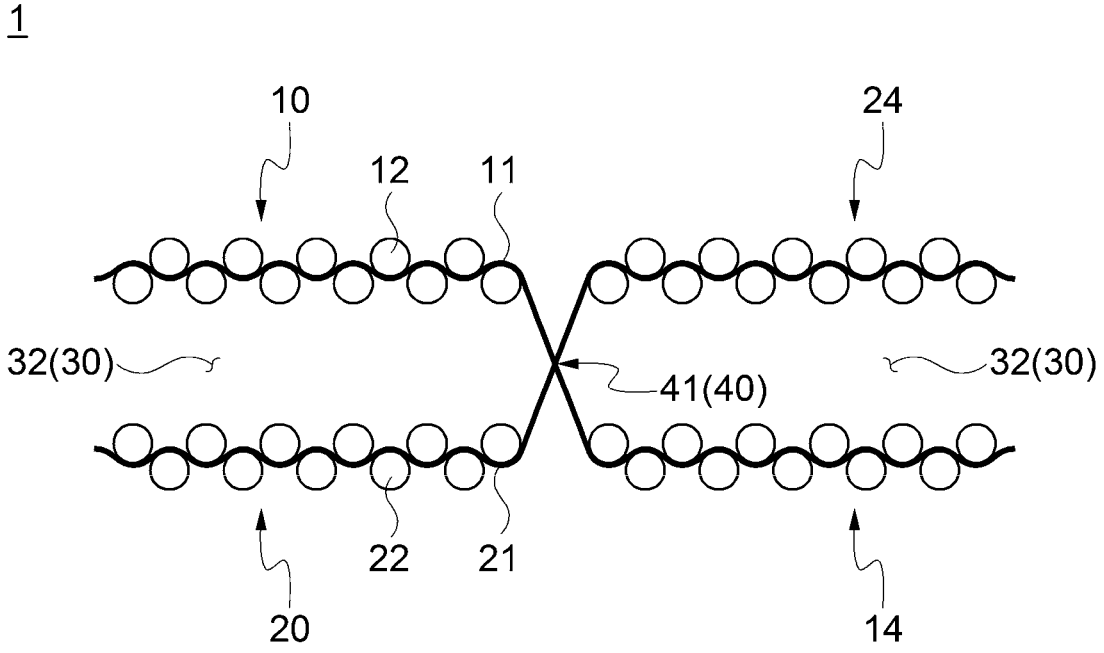
FIGS. 4, 5 and 6 are views illustrating warps and wefts of the woven fabric according to one embodiment of the present invention.
Figure 5:
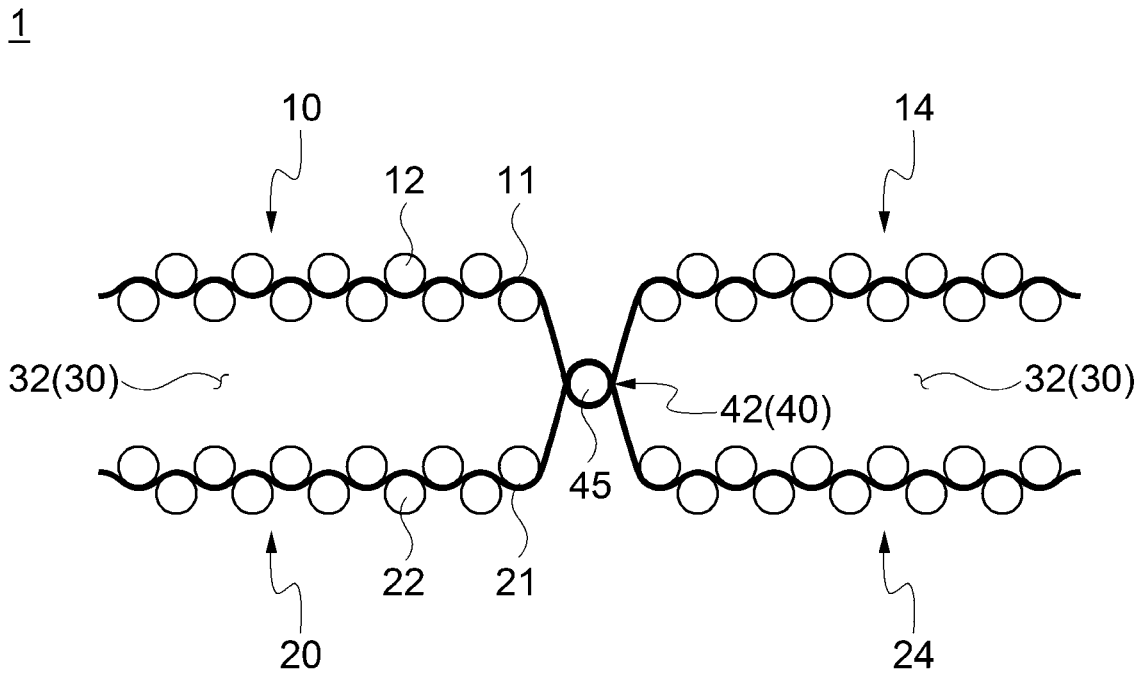
Figure 6:
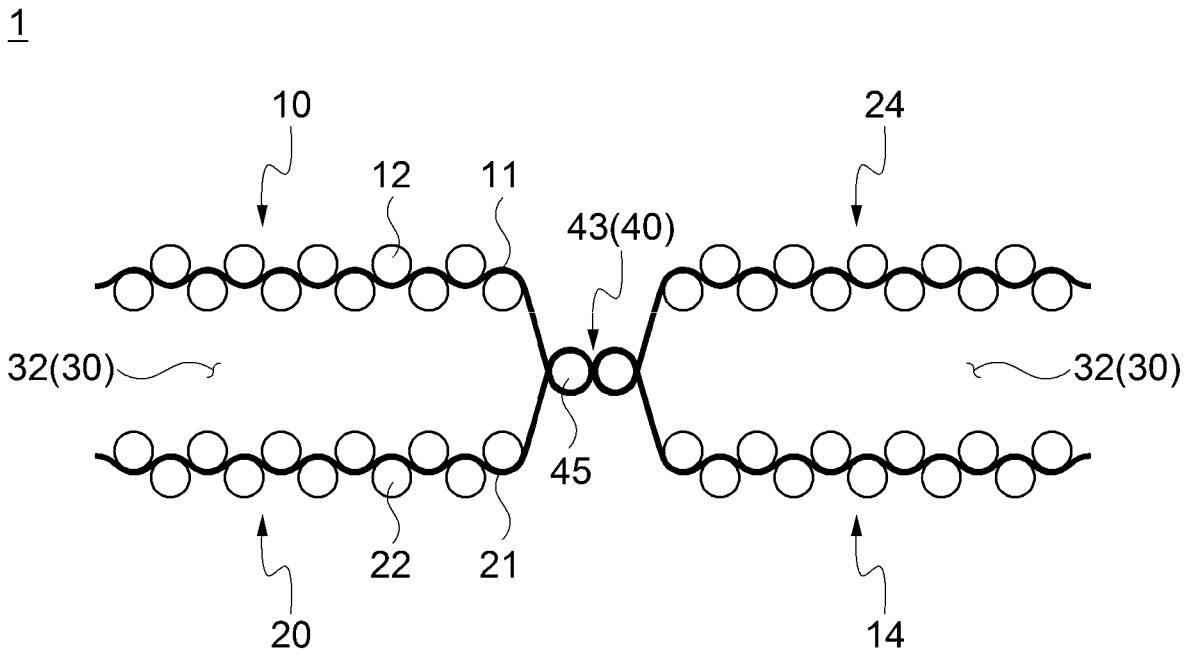

FIGS. 4, 5 and 6 are views illustrating warps and wefts of the woven fabric according to one embodiment of the present invention.

The coupling part 40 may partition the down filling part 30 formed in the first and second fabric layers 10 and 20 into the plurality of down filling spaces 32.

In the woven fabric 1, the fabric layers 10 and 20 may be partitioned through the coupling part 40 without seams, and the plurality of down filling spaces 32 divided by the coupling part 40 may be filled with a thermal insulating material, thereby enabling balanced filling. Further, since the woven fabric is provided with the plurality of down filling spaces 32, it is possible to prevent the thermal insulating material from concentrating to one side of the down filling part 30 even with the lapse of time. Further, the woven fabric 1 may omit the seams due to the coupling part 40, thereby excluding a limitation in applying patterns to the woven fabric 1.

The coupling part 40 may be configured to cross the first and second warps 11 and 12 to each other at least one time. The coupling part 40 may include first to third coupling parts 41, 42 and 43 divided by the number of crossing the first and second warps 11 and 12 or by intercrossing the first and second fabric layers 10 and 20.

As shown in FIG. 4, the coupling part 40 may be configured to cross the first and second warps to each other one time. As shown in FIG. 2, the coupling part 40, in which the first and second warps 11 and 12 are crossed to each other one time, may be referred to as a first coupling part 41. The first coupling part 41 may partition the down filling part 30 formed in the first and second fabric layers 10 and 20 into the plurality of down filling spaces 32.

For the first coupling part 41, the first and second fabric layers 10 and 20 may be configured so that positions thereof are crossed about the first coupling part 41. That is, if the first fabric layer 10 is located outside from the second fabric layer 20, the second fabric layer 20 may be crossed so as to be located outside from the first fabric layer 10 by the first coupling part 41 about the first coupling part 41. In such a context, the space forming part 14 in the first fabric layer 10 and the space forming part 24 in the second fabric layer 10 may be located so as to be crossed to each other about the first coupling part 41.

As shown in FIGS. 4 and 5, the coupling part 40 may be configured to cross the first and second warps 11 and 12 to each other at least two times. The coupling part 40 may include the coupling weft 45. The coupling weft 45 may include at least one weft of first and second wefts 12 and 22. In a case of the coupling weft 45, wefts of the first and second wefts 12 and 22, which are located in the coupling part 40, may be defined as the coupling wefts 45. However, it is not limited thereto, and the coupling weft 45 may be also defined as a separate weft which is distinguished from the first and second wefts 12 and 22. The coupling weft 45 in the coupling part 40 allows the first and second fabric layers 10 and 20 to be crossed or not in terms of the position about the coupling part 40 depending upon the number of the coupling wefts.

The coupling part 40 of the woven fabric may be formed by a plurality of coupling wefts 45 so that the coupling part 40 is arranged in a plane as shown in FIG. 2. Based on such a configuration, the coupling part 40 may stably partition the down filling space 32, and may improve air-tightness of the down filling space 32.

As shown in FIG. 5, the coupling part 40 provided with an odd number of coupling wefts 45 may be defined as a second coupling part 42. Further, as shown in FIG. 6, the coupling part 40 provided with an even number of coupling wefts 45 may be defined as a third coupling part 43. In such a context, the above-described first coupling part 41 may be defined as a part in which the coupling weft 45 is omitted.

The second coupling part 42 may include the coupling wefts 45 in an odd number, that is, 2n+1 (wherein n is an integer of 0 or more). Unlike the first coupling part 41, the second coupling part 42 may be configured so that the first and second fabric layers 10 and 20 are not crossed to each other in terms of the position. In other words, if the first fabric layer 10 is located outside from the second fabric layer 20, the first fabric layer 10 may be located outside from the second fabric layer 20 even when the second coupling part 42 is formed.

The third coupling part 43 may be provided with an even number, that is, 2 n (wherein n is an integer of 1 or more) of coupling wefts 45. Similar to the first coupling part 41, the third coupling part 43 may be configured so that the first and second fabric layers 10 and 20 are crossed to each other in terms of the position. In other words, if the first fabric layer 10 is located outside from the second fabric layer 20, the second fabric layer 20 may be crossed so as to be located outside from the first fabric layer 10 about the third coupling part 43.

With regard to the first and third coupling parts 40, that is, 41 and 43, the first and second fabric layers 10 and 20 may be provided so as to be crossed in terms of the position. With regard to the second coupling part 42, the first and second fabric layers 10 and 20 may be provided so as not to be crossed in terms of the position. Therefore, based on whether the first and second fabric layers 10 and 20 are intercrossed or not, the first and third coupling parts 40 may be defined as the first coupling part 41. In this case, the coupling weft 45 is used in the number of 2 n (wherein n may be defined as an integer of 0 or more).

As described above, seams of the woven fabric 1 are eliminated due to the coupling part 40, such that a down filling space exhibits improved air-tightness to enhance thermal insulation properties. Further, the first and second fabric layers 10 and 20 may be optionally intercrossed, such that a variety of fabric materials may be applicable. In addition, a plurality of fabric layers may be simultaneously woven, thereby reducing processing costs and time, and easily performing pre-treatment and a dyeing process of the fabric layer.

Figure 7A:
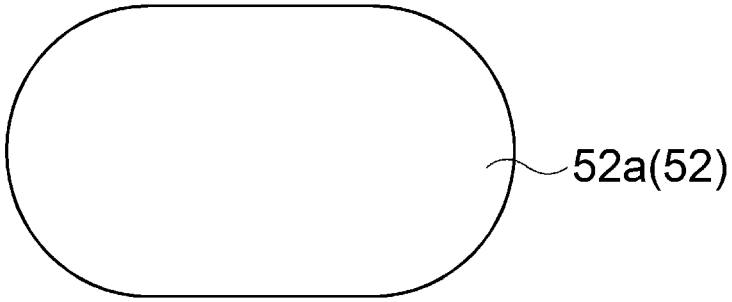
FIGS. 7A and 7B are cross-sectional views illustrating a second yarn of the woven fabric according to one embodiment of the present invention.
Figure 7B:
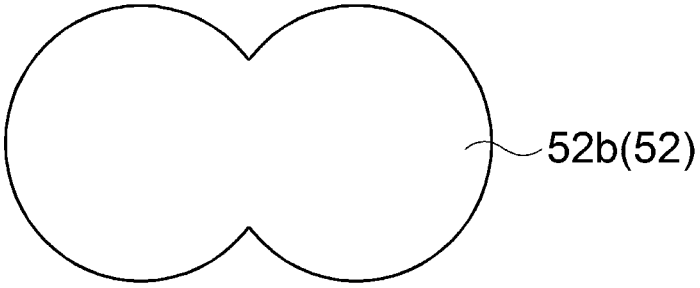
Figure 8:
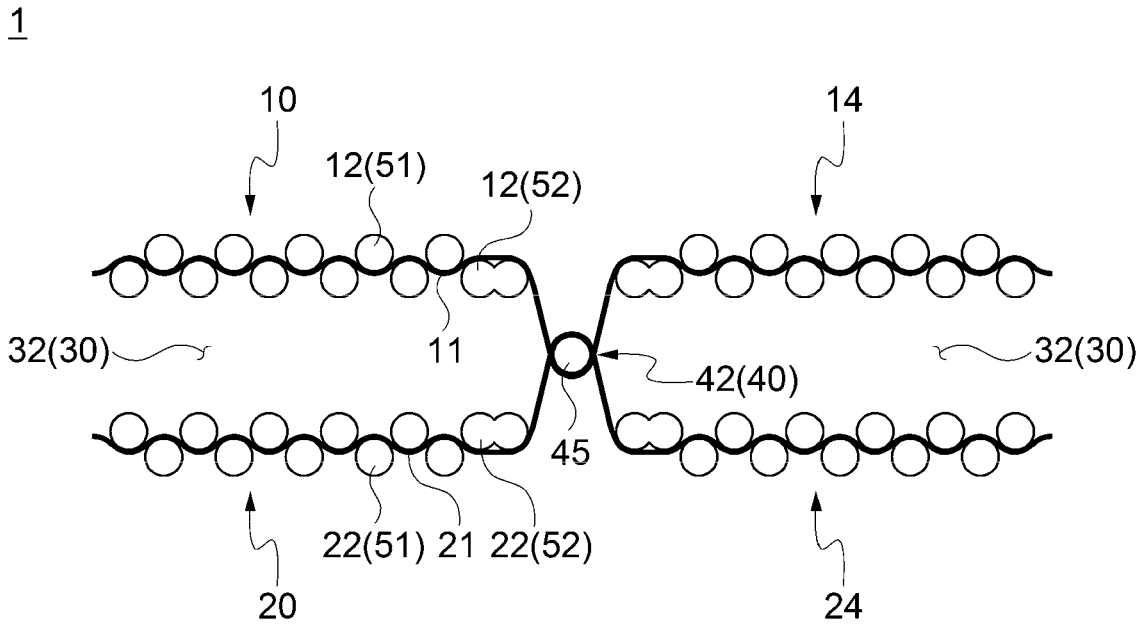
FIGS. 8, 9 and 10 are views illustrating alignments of the second yarn with respect to the warps and the wefts of the woven fabric according to one embodiment of the present invention.
Figure 9:
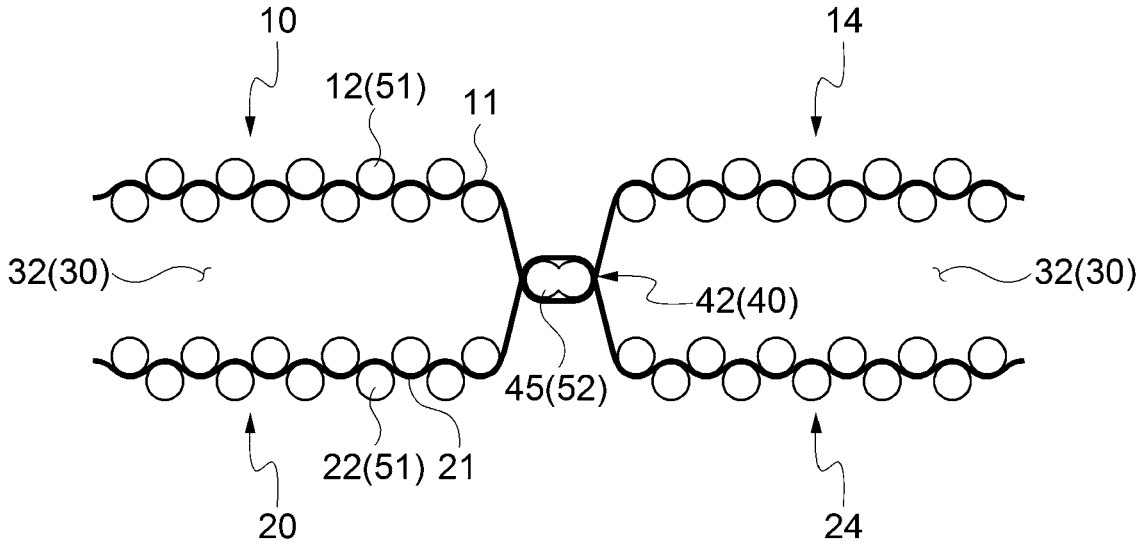
Figure 10:
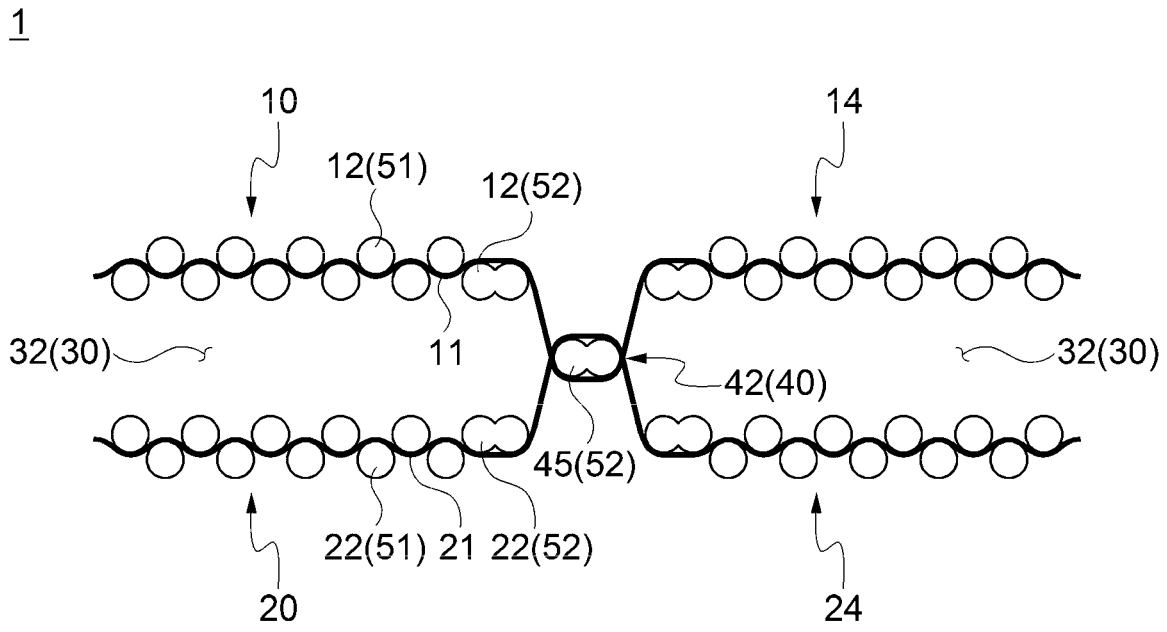

FIGS. 7A and 7B are cross-sectional views illustrating a second yarn of the woven fabric according to one embodiment of the present invention, and FIGS. 8, 9 and 10 are views illustrating alignments of the second yarn with respect to the warp and the weft of the woven fabric according to one embodiment of the present invention.

The first and second wefts 12 and 22, and the coupling weft 45 may be formed so as to have different cross-sectional aspect ratios from each other. Specifically, the cross-sectional aspect ratio of at least one weft among the wefts may be set so as to be different from those of other wefts. The first and second wefts 12 and 22 may be separate wefts from the coupling weft 45. Otherwise, as described above, the coupling weft 45 may be a portion of any one weft of the first and second wefts 12 and 22.

The wefts 12, 22 and 45 may include a first yarn 51, and a second yarn 52 having a larger aspect ratio than that of the first yarn 51. That is, the second yarn 52 may be provided so as to have a transverse width larger than a longitudinal height of the first yarn 51 in terms of a cross-section area. That is, the second yarn 52 may be formed so as to have a larger width than that of the first yarn 51.

As shown in FIG. 7A, the second yarn 52 may have an elliptical shape in terms of the cross-section wherein a width in a transverse direction is larger than a height in a longitudinal direction. However, the cross-sectional shape of the second yarn 52 is not limited thereto, and the second yarn may have any shape as long as it can satisfy the configuration having a larger aspect ratio than that of the first yarn 51. For example, as shown in FIG. 7B, the second yarn 52 may be formed so as to have a width in the transverse direction larger than a height direction, wherein the yarn is partially concaved in the transverse direction.

As shown in FIG. 8, the second yarn 52 may be located at positions adjacent to the coupling part 40 in the first and second wefts 12 and 22. Further, the first and second wefts 12 and 22 may include the second yarn 52 which is arranged adjacent to the coupling part 40. More particularly, portions located in the space forming parts 14 and 24 adjacent to the coupling part 40 in the first and second wefts 12 and 22 may consist of the second yarns 52. The second yarn 52 may be arranged adjacent to the coupling part 40, such that, if a tension occurs in the longitudinal direction of the first and second warps 11 and 12, the second yarn 52 may be extended in the transverse direction of the cross-section. Through flexibility of the second yarn 52 in the transverse direction of the cross-section, air-tight efficiency of the down filling space 32 may be enhanced at portions of the first and second fabric layers 10 and 20 adjacent to the coupling part 40.

As shown in FIG. 9, the second yarn 52 may also be arranged in the coupling part 40. The coupling weft 45 of the coupling part 40 may include the second yarn 52. That is, the coupling weft 45 may consist of the second yarns 52. For convenience of the explanation, an example, in which the second yarn 52 is employed as the coupling weft 45 of the second coupling part 42, has been described, but it is not limited thereto. If a plurality of coupling wefts 45 are provided, at least some of the plurality of coupling wefts 45 may consist of the second yarns 52. Based on such a configuration, air-tight efficiency of the down filling space 32 to the coupling part 40 may be enhanced.

As shown in FIG. 10, the second yarns 52 may be arranged in the coupling part 40, and the first and second wefts 12 and 22 adjacent to the coupling part 40, respectively. That is, as shown in FIG. 10, wefts of the first and second yarns, which are located adjacent to the coupling part 40, and the coupling weft 45 of the coupling part 40 may consist of the second yarns 52. Based on such a configuration, air-tight efficiency of the down filling space 32 may be enhanced with respect to the coupling part 40 and the portions of the first and second fabric layers 10 and 20, which are adjacent to the coupling part 40.

As such, specific embodiments of the present invention have been illustrated and described in detail. However, the present invention is not limited to the above embodiments, and it will be understood by those skilled in the art that various alterations and modifications may be implemented without departing from technical spirits of the invention described in the following claims.

DESCRIPTION OF REFERENCE NUMERALS

1: Woven fabric
10: First fabric layer
11: First warp
12: First weft
20: Second fabric layer
21: Second warp
22: Second weft
30: Down filling part
32: Down filling space
40: Coupling part
41: First coupling part
42: Second coupling part
43: Third coupling part
45: Coupling weft
51: First yarn
52: Second yarn

The invention claimed is:

1. A seamless double-woven fabric for filling down, comprising:

a first fabric layer comprising a plurality of first warps and a plurality of first wefts;

a second fabric layer comprising a plurality of second warps and a plurality of second wefts; and a coupling part partitioning a down filling part which is formed between the first and second fabric layers into a plurality of down filling spaces, the coupling part including a coupling weft, wherein the first warp wraps a half of a perimeter of the coupling weft;

the second warp wraps another half of the perimeter of the coupling weft;

the coupling weft is between the first warp and the second warp; and the first and second warps are crossed at the coupling weft and coupled to the coupling weft.

2. The woven fabric according to claim 1, wherein the first and second warps, and the first and second wefts respectively comprise at least one of nylon yarn, polyester yarn, polyester mechanical stretch, elastomeric yarn, a covering yarn comprising nylon yarn or polyester yarn, and a composite yarn comprising nylon yarn or polyester yarn in a core or cis structure.

3. The woven fabric according to claim 1, wherein the first and second wefts and the coupling weft respectively comprise:

a first yarn; and a second yarn having a larger cross-sectional aspect ratio than that of the first yarn.

4. The woven fabric according to claim 3, wherein at least some wefts of the first and second wefts, which are adjacent to the coupling part, consists of the second yarns.

5. The woven fabric according to claim 4, wherein the coupling weft consists of the second yarns.

6. The woven fabric according to claim 1, wherein at least one of the first weft and the second weft has a fineness of 5 to 70 deniers.

7. The woven fabric according to claim 1, wherein the first warp, the first weft, the second warp and the second weft respectively have a fineness of 5 to 70 deniers, and the first fabric layer and the second fabric layer have a warp density of 157 to 207 pieces/cm and a weft density of 126 to 142 pieces/cm.

* * * * *